US005235891A

United States Patent [19]

Klein

[11] Patent Number: 5,235,891

[45] Date of Patent: Aug. 17, 1993

[54] LIGHTWEIGHT SOLID BODY GUITAR

[76] Inventor: Matthew L. Klein, 1906 Broadway, Nashville, Tenn. 37203

[21] Appl. No.: 765,457

[22] Filed: Sep. 25, 1991

Related U.S. Application Data

[63] Continuation of Ser. No. 921,781, Oct. 22, 1986, abandoned.

[51] Int. Cl.[5] ..... G10D 1/08

[52] U.S. Cl. ..... 84/291

[58] Field of Search ..... 84/291, 275, 452 R

[56] References Cited

U.S. PATENT DOCUMENTS

| | | | |
|---|---|---|---|
| 1,004,905 | 10/1917 | Riga | 84/291 |
| 3,427,915 | 8/1964 | Mooney | 84/275 |
| 3,440,919 | 4/1969 | Baker | 84/291 |
| 3,641,862 | 2/1972 | Rendell | 84/291 |
| 4,103,583 | 8/1978 | Takahayashi | 84/291 |
| 4,185,534 | 1/1980 | Cove | 84/291 |
| 4,290,336 | 9/1981 | Peavey | 84/291 |
| 4,472,994 | 9/1984 | Armstrong | 84/291 |

*Primary Examiner*—Michael L. Gellner
*Assistant Examiner*—Cassandra Spyrou

[57] ABSTRACT

An improved solid body guitar structure wherein the solid body is formed of a combination of balsa wood with sufficient hard wood allied therewith to provide structural rigidity to the instrument. The balsa/hard wood body block is then skinned with selected veneer material on one or more surfaces thereby to render an extremely strong and rigid solid body that is much lessened in weight. Hard wood portions of the body block are relied upon for interconnection to the neck/peghead guitar structures. Further weight relief and acoustical adjustment may be effected by removal of small portions of the hard wood at selected non-stress, low resonance points.

17 Claims, 4 Drawing Sheets

LIGHTWEIGHT SOLID BODY GUITAR

This is a continuation of copending application Ser. No. 06/921,781 filed on Oct. 22, 1986 now abandoned.

BACKGROUND OF THE INVENTION

1. Field of the Invention

The invention relates generally to a lightweight solid body guitar and, more particularly, but not by way of limitation, it relates to an improved solid body guitar constructed largely of balsa wood yet having all necessary features of strength and tonal response.

2. Description of the Prior Art

Applicant has discovered no prior art that is directly in point in that it teaches the lessening of weight of a solid body guitar by using a skinned balsa wood. The closest prior art may be characterized by a U.S. Pat. No. 4,185,534 which teaches construction of a low cost, reduced weight guitar wherein the solid body is a foamed polystyrene. This construction enables lightweight and what amounts to a good practice type of guitar; however, the polystyrene body exhibits poor sound qualities and contributes nothing to desirable intonation. U.S. Pat. No. 3,427,915 in the name of Mooney teaches the construction of a multi-ply panel for the use in hollow body stringed instruments such as a violin wherein a strip of balsa can serve as a center ply between rigidifying outer plys. This is still a usage contributing to a sheet material and not such as a solid material suitable for solid body stringed instruments. Little if any other teachings have been encountered which relate to even similar usages of material to lighten solid body instruments, especially without destroying or greatly altering tonal quality.

SUMMARY OF THE INVENTION

The present invention relates to improvements in solid body stringed instruments which improvements are directed largely to lessening of weight without sacrificing structural rigidity and strength and without loss of tonal quality. The invention contemplates the construction of a skinned, solid guitar body wherein somewhat greater than half of the internal volume is made up of balsa wood. The construction maintains the requisite strength and rigidity as to certain stresses usually encountered in guitar building and handling, and the solid body assemblage imparts a unique tonal quality in functional operation.

Therefore, it is an object of the present invention to provide a high quality, high reliability stringed instrument that is much lighter in overall weight.

It is also an object of the present invention to provide a lightweight stringed instrument that generates a desirable tone.

It is still further an object of the invention to provide a lightweight guitar body design that still has the capability for receiving the full range of screen prints, glosses and finishes.

Finally, it is an object of the invention to provide a solid body guitar that is noticeably lighter in weight than comparable solid body guitars and that does not suffer deterioration of intonation but, in fact, exhibits a desirable new sound.

Other objects and advantages of the invention will be evident from the following detailed description when read in conjunction with the accompanying drawings which illustrate the invention.

DETAILED DESCRIPTION OF THE INVENTION

Figure 1:
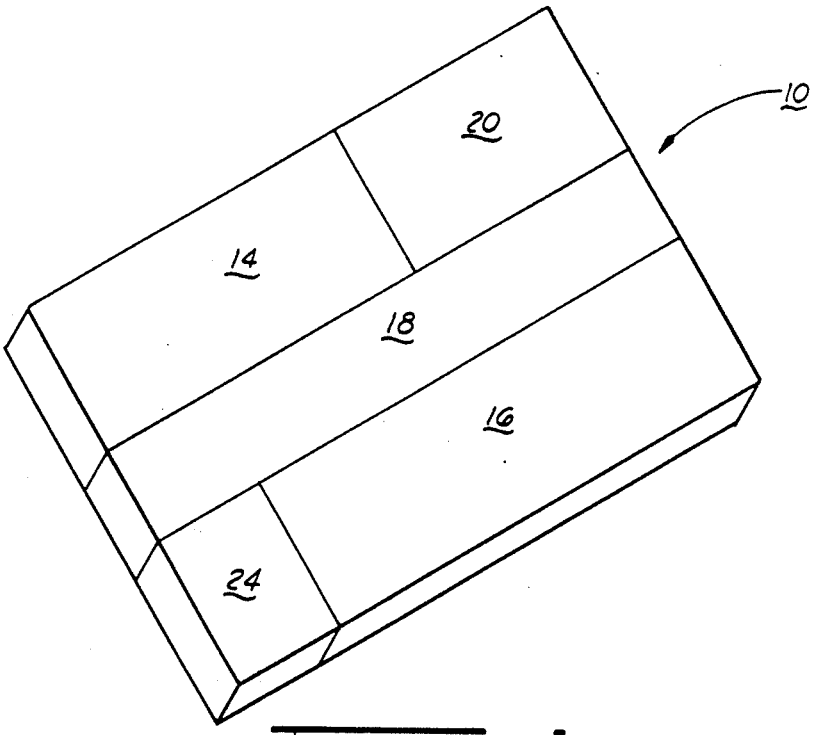
FIG. 1 is a view in perspective of a composite wood blank made up in accordance with the present invention.
Figure 2:
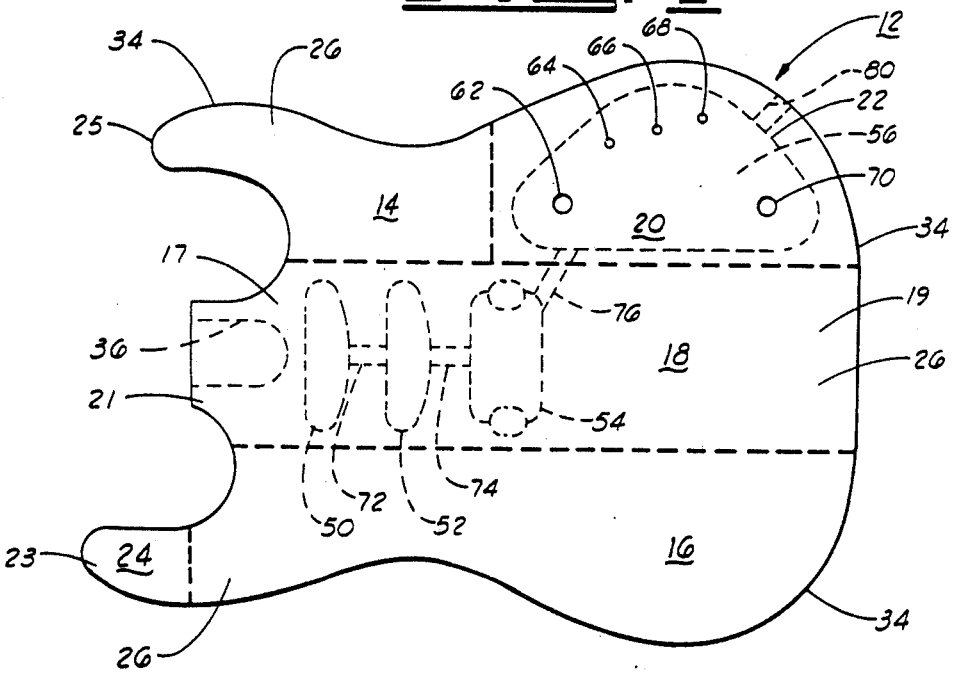
FIG. 2 is a plan view with parts shown in dashed outline of a guitar body block cut out of the composite blank of FIG. 1.
Figure 3:
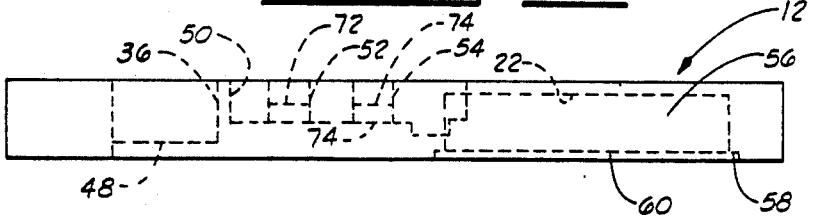
FIG. 3 is a view in side elevation of the block of FIG. 2 with surface cutaway portions shown in dashed outline.

As shown in FIG. 1, a solid wood composite blank 10 is first constructed so that the wood types will be complementary with the desired positions on the instrument body block 12, as shown on FIGS. 2 and 3. Thus, as shown in FIG. 1, the composite body blank 10 is laid out so that the balsa portions 14 and 16 will comprise slightly more than half of the finished guitar body block 12. The primary structural rigidity is achieved by means of the center plank 18 of mahogany which functions to receive connection to the guitar neck in structurally rigid manner as well as to provide mountings for the various pick-up members and bridge and tail piece, as will be further described below.

A smaller volume mahogany block 20 forms one corner of composite blank 10 and functions later to provide an accessory component cavity for electronic control assemblies. As shown in FIG. 2, block portion 20 of mahogany is milled out from the bottom side to provide an accessories cavity within the boundaries shown by dashed line 22. Finally, a small corner of mahogany 24 is provided on the opposite corner of composite plank 10 in order to provide a solid anchoring position for a screw-mounted strap button.

While guitar body block 12 is cut in the form known as the double cutaway, any of various guitar shapes, as will be further described below, may be formed. Also, addendum block portions of hard wood may be further reduced or lessened by removal of material at selected points thereby making the instrument even lighter in weight.

The composite blank 10 is made by assembling the blocks of balsa and other hard woods, such as mahogany, and bonding them together with a selected wood glue in the manner as shown in FIG. 1. The blocks are placed in the composite form with bonding agent and maintained clamped under pressure for a period of time sufficient to assure good bonding strength. Thereafter, the composite blank 10 is cut in the peripheral guitar outline such as body block 12 as the individual balsa components 14, 16 and hard wood sectors 18, 20 and 24 appear in their designated positions. Thus, block 12 is cut into such as the classic cutaway shape having upper and lower bout 17 and 19, tenon shoulder 21, and bass and treble horns 23 and 25. At this point, external surfaces of body block 12 are further covered with suitable veneer which provides both a quality appearance finish and a rigidifying skin tending to give the overall lighter body member greater relative structural strength.

Figures 4, 5, 6:
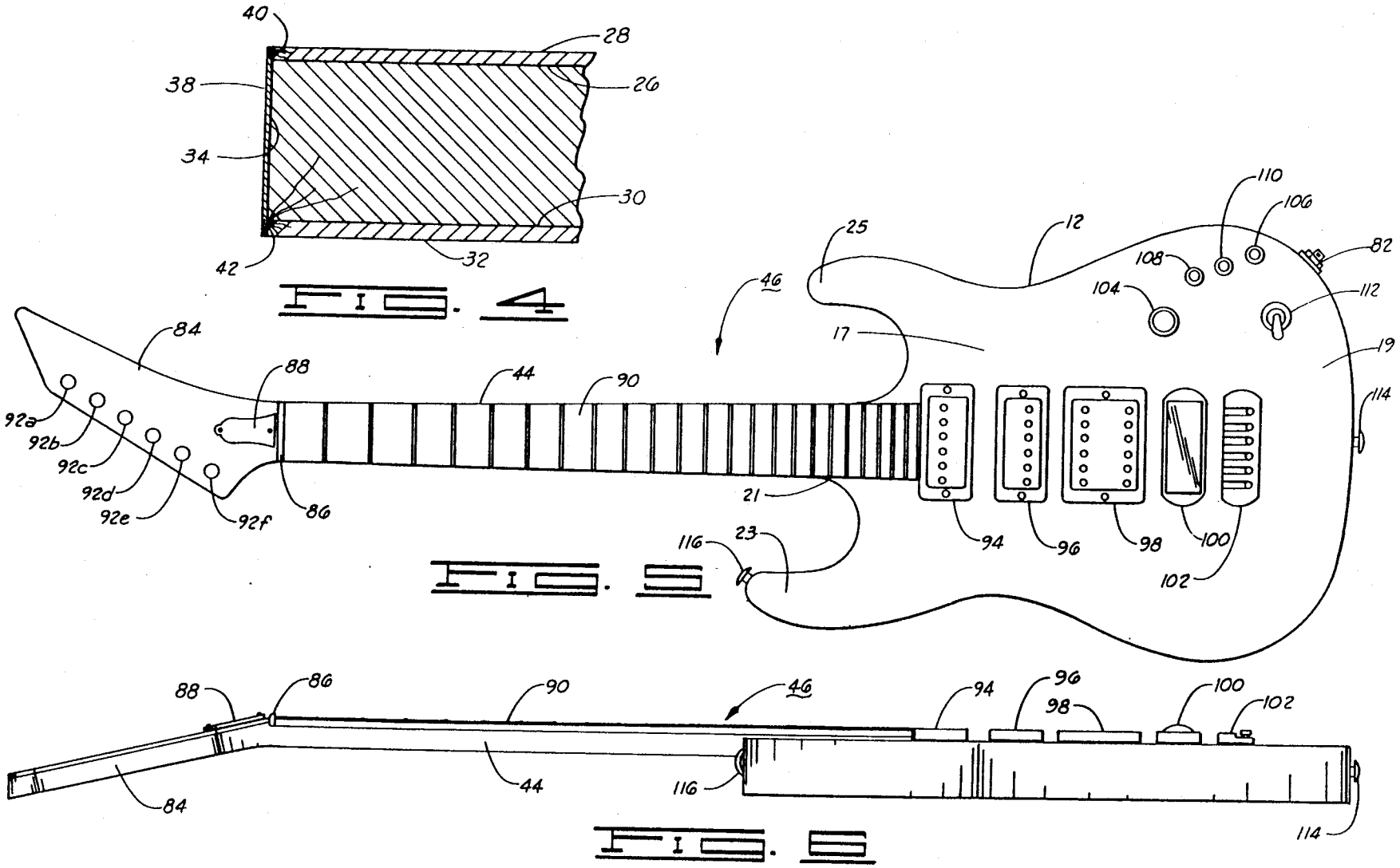
FIG. 4 is a view in section of a portion of the guitar body with veneer skin bonded in position.
FIG. 5 is a top plan view of a solid body guitar constructed in accordance with the present invention.
FIG. 6 is a view in side elevation of the solid body guitar of FIG. 5.

Thus, and as shown in FIG. 4, the top surface 26 of body block 12 may receive a hard wood veneer 28, e.g. a 0.110 inch flamed maple layer, over the entire surface. In like manner, the bottom surface 30 of body block 12 may also receive a similar type of veneer 32, i.e. a 0.110 inch maple sheeting securely bonded thereover. All edge surfaces 34 of body block 12, save the neck insert tenon 36, receive a side veneer 38, all such as 0.0625 inch maple veneer bonded thereon with rabbeted binding at the top and bottom edges 40, 42.

While the balsa wood is required in order to maintain lightness in weight, the mahogany sections may be substituted with other suitable hard woods as are generally used in stringed instrument construction. Also, the flamed maple and other maple veneers may consist of other wood veneers such as mahogany, spruce, rosewood and the like.

After formation of the basic guitar body block 12 and the subsequent skinning with veneers 28, 32, 38 to the top surface 26, bottom surface 30 and edges or side surfaces 34, the guitar body is subjected to a milling procedure which mills or routs certain areas of the body block for connection or installation of additional functional components. As shown in FIG. 3, a number of pre-formed cavities, conduit passages and the like must be formed in the guitar body.

Thus, the center plank 18 is positioned to align with a neck 44 of guitar 46 (see FIGS. 5 and 6). The neck 44 is formed with an insert block (not shown) which is received in insert portion 36 of block 12 in interlocked, bonded affixure. In some cases, the neck 44 may be affixed with bolts but it may suffer some tonal loss, or change. A lower shelf 48 is left to remain along the bottom extremity of insert portion 36. Laterally elongated cut-outs 50 and 52, about half the depth of thickness of body block 12, are formed in closely spaced relationship from insert portion 36. Cut-outs 50 and 52 are provided to accommodate electronic pick-ups, for example, single coil pick-ups. A cut-out 54 is formed on further toward the base to accommodate a double coil pick-up, e.g. a type that is known as a humbucker pick-up or the like.

An accessories cavity 56 (FIG. 3) is formed by milling from the bottom of body block 12 in the area defined by dash line 22. A further annular shoulder 58 is milled out to provide a seating surface for a cover panel 60 to be secured thereover as by screw fasteners. Access from electronics accessories cavity 56 to the front face of body block 12 is via holes 62, 64, 66, 68 and 70 (FIG. 2). Longitudinal holes are drilled or formed as at 72, 74, 76 and 80 to provide wire routing ways as between the electronic pick-ups and accessories cavity 56 as well as for connection to an external connector jack 82.

FIGS. 5 and 6 illustrate the guitar 46 in its finally assembled form, but without strings and crank winders. Thus, the guitar solid body 12 is rigidly secured to neck 44 which, in turn, is secured to a peghead 84 at the nut 86. A removable bell-shaped plate 88 allows access to a truss rod (not shown) that extends down the length of neck 44 beneath the fret board 90. A plurality of cut-outs **92*a*–92*f*** provide seating for string crank winder assemblies (not shown). In the event of a bass guitar structure, only four such cut-outs would be formed.

At the base of board 90, a pair of single coil electronic pick-ups 94 and 96 are secured in cut-outs 50 and 52 (FIG. 3) to be disposed below string level. In like manner, a double row pick-up 98 is similarly secured within cut-out 54 (FIG. 2). A tunable bridge 100 then supports guitar strings that are led thereacross and anchored securely in tailpiece 102. Each of tunable bridge 100 and tailpiece 102 are firmly secured by fasteners anchored in the center plank 18 (FIG. 2) of guitar body 12. Once again, for a bass guitar the pick-ups, bridge and tailpiece would be varied accordingly.

Rotary control shafts extending from electronic components in cavity 56 are controllable by knobs 104, 106, 108 and 110. A toggle switch 112 may provide further control as between modes of operation, e.g. rhythm versus treble tone response. A pair of strap connector buttons 114 and 116 are securely anchored in respective hard wood portions as button 114 is secured in center plank 18 and button 116 is secured in tip hard wood portion 24 (see FIG. 2).

The solid body guitar 46 is constructed with all of the components and capabilities of existing solid body guitars except that the body block 12 has been lightened in weight by a significant factor. While being light in weight, body block 12 is rendered very sturdy by skinning with veneers 28, 32 and 34, and the linear interconnection of peghead 84, neck 44 and longitudinal block 18 provides the requisite longitudinal rigidity. Longitudinal rigidity is further maintained, adjustably, by inclusion of the truss rod (not shown) extending within neck 44. While lightening of the body block 12 may change acoustic properties, the guitar 46 is found to play with new and extremely interesting tonal response.

Figure 7:
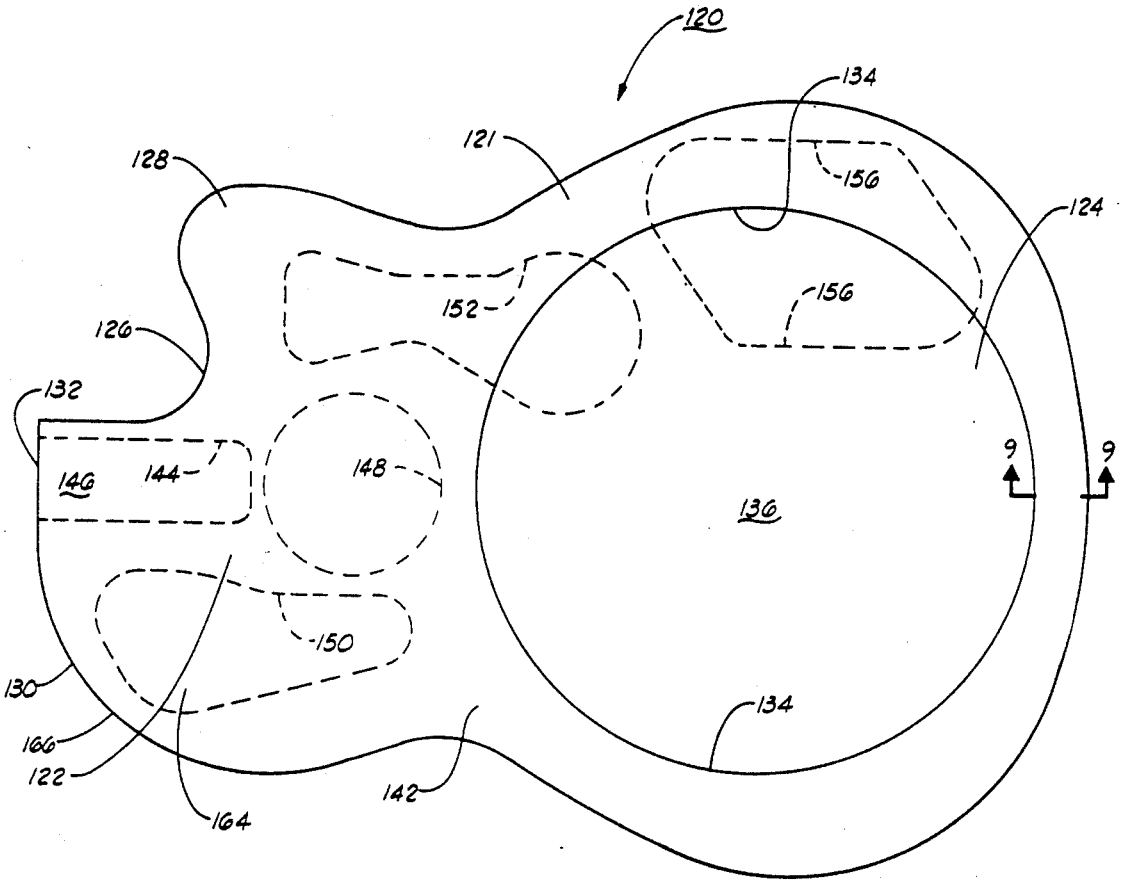
FIG. 7 is a plan view with selected cut-out portions shown in dashed outline of an alternative form of guitar body block.
Figure 8:
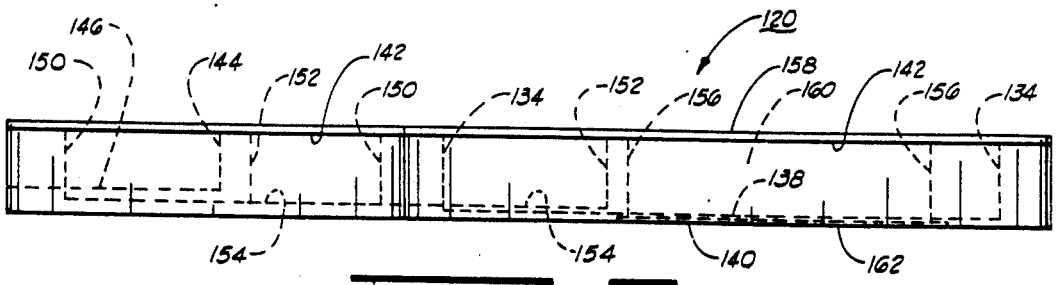
FIG. 8 is a view in side elevation of the block of FIG. 7 with surface cutaway portions shown in dashed outline.

Referring now to FIGS. 7 and 8, a guitar body block 120 is illustrated which is adapted to utilize the similar weight reduction measures. Thus, guitar body block 120, a single cutaway body type, may utilize such as a hard wood outer frame 122, e.g., mahogany, forming the upper bout 122 and a lower edge of a lower bout 124 as upper bout 122 is formed with a single cutaway 126 and rounded horn 128 on the treble side. The bass side of upper bout 122 is formed as a rounded shoulder 130 merging into neck tenon 132. A generally circular cut 134 is milled out of block 120 to receive a balsa wood block 136 bonded therein. As shown also in FIG. 8, the milled cut 134 is milled relatively deeply to define a bottom or base 138 displaced on the order of 3/16 inches from the bottom surface 140 of body block 120. Balsa wood block 136 is cut and sized to be received firmly within cut 134 while completely filling the void down to bottom 138. It should be understood that cut 134 may take any of various configurations so long as the requisite volume is removed.

After the basic body block 120 is formed of the hard wood outer frame 121 with inserted balsa block 136, one or more milled cuts are made through the top surface 142 for the purpose of weight removal, acoustics enhancement, component housings or neck joinder. Refer also to FIG. 8, a mortise 144 having a base surface 146 is milled out of tenon shoulder 132 for the purpose of receiving the neck tenon (not shown) thereby to form a secure tenon joint. A sound hole 148 may also be milled downward through a portion of body block 120 and this is primarily for aesthetic purposes as a plastic insert cup with filigree or similar decoration is generally placed therein beneath the strings. Milled portions shown by dash-lines 150 and 152 are removed not only to effect additional lessening of weight, but also to enhance acoustic properties. Milled portions 150 and 152 are at strategic locations and may be taken down to a base line or surface 154. Finally, a milling within dash-lines 156 may be effected to provide for electronic control components, the size of formation being pro-portional to the number and type of components.

The top surface 142 of body block 120 with the various milled out portions is then covered over by a suitable hard wood veneer 158. Similarly, veneers of selected wood formation or grain pattern may be applied over the bottom surface and/or side surfaces of guitar body block 120 in like manner. The component cavity 160 formed within milled cut lines 156 is formed to open through the bottom surface of body block 120 to allow for testing and repair access to the components. The cavity 160 is covered over by a suitable wood or plastic plate 162 secured as by set screws or the like. It is a viable option to eliminate cavity 160 while placing control components in the area 164 of milled portion 150. Locating components at this position also enables the ability to place thumb wheel controls in the body edge surface at position 166, a convenient control location.

Figure 9:
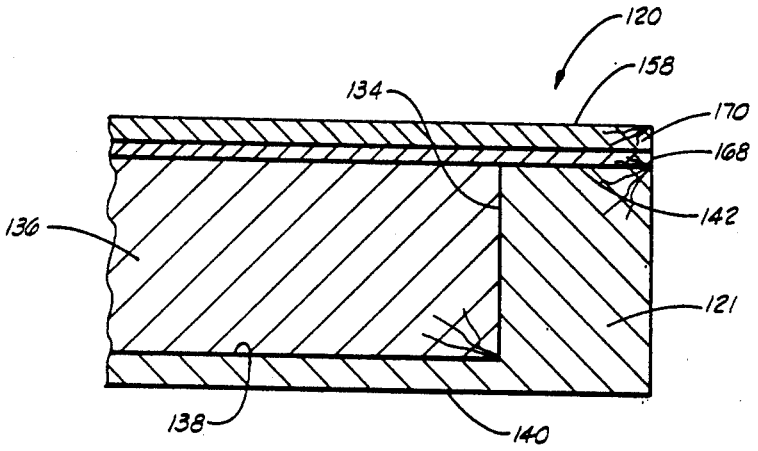
FIG. 9 is a partial vertical section taken along lines 9—9 of FIG. 7.

Referring to FIG. 9, the sectional view of a portion of the body block 120 illustrates in greater detail the manner whereby veneer 158 is placed as the top skin over the guitar body. Thus, the hard wood block 121 is milled out along wall 134 down to a base 138. The balsa wood insert 136, e.g., approximately a 10 inch disk of balsa wood, is then placed securely down within the cavity side walls 134 and flush to cavity base 134. In preferred form, a double veneer is used for the top veneer 158. Thus, a first, thinner veneer 168 may be such as a 0.085 inch basswood veneer laid in crossband relative to the predominant grain of an upper veneer 170 which may be 0.110 inch spruce. Other woods of similar consistencies may be substituted so long as predominant grain patterns are maintained in a right angular relationship thereby to provide greatest structural strength and rigidity.

Figure 10:
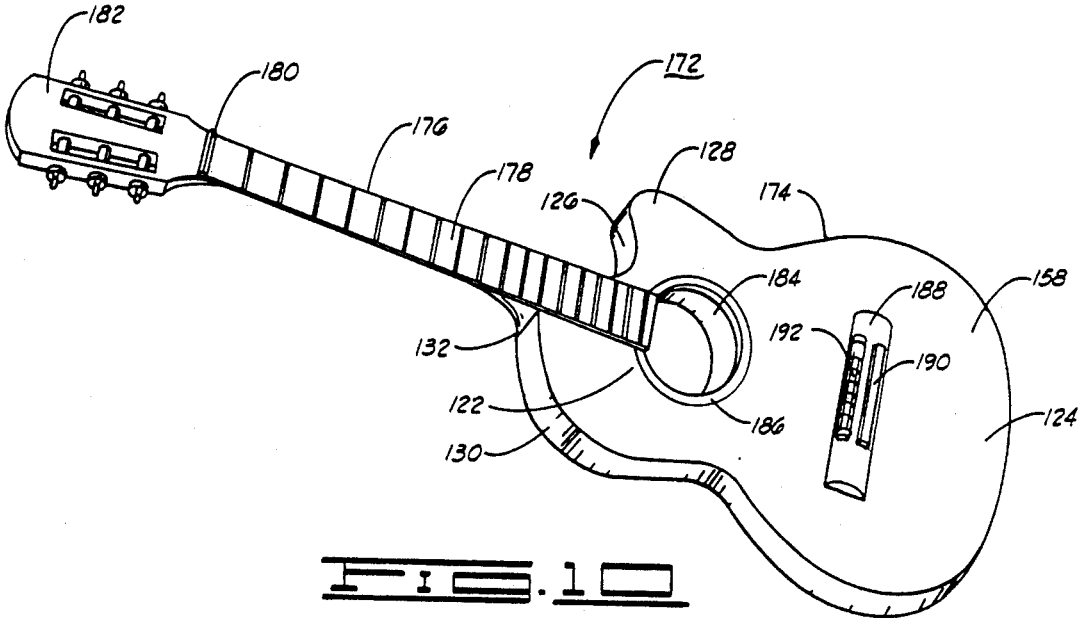
FIG. 10 is a perspective view of a solid body guitar constructed utilizing the blank of FIG. 7.

FIG. 10 illustrates a single cutaway guitar 172 in finally assembled form (without strings). The guitar 172 consists of a body 174 having upper bout 122 and lower bout 124, a body as constructed in accordance with the illustrations of FIGS. 7, 8 and 9. A neck 176 is secured to body 174 by means of a joinder at tenon joint 132 and a fret board 178 is secured thereon. Fret board 178 extends from a nut 180 at the base of a peghead 182 down to a point adjacent a soundhole insert 184. The insert 184 is secured within the hole to provide decorative effect including a rosette or classic rim design 186. Soundhole insert 184 is also readily removable to allow access to the truss rod nut (not shown).

A bridge 888, formed of rosewood or such, is suitably secured as by bonding within the veneer structure of top veneer 158 Bridge 188 must be secured sufficiently rigid to withstand the string tension applied thereon. Bridge 188 includes a tail piece 190 securing the individual guitar strings (not shown) as they are then led across a bridge piece 192 and upward across nut 180 to the peghead 182. In preferred form, the bridge piece 192 includes an integral piezoelectric transducer that may be tuned by individual trim pots accessible from the underside of the guitar body.

The foregoing discloses a unique construction and method of manufacture for solid body guitars wherein the instrument is rendered considerably lighter in weight without suffering loss of sound quality while, in fact, gaining in tonal character. Sufficient hard wood is retained in the guitar body to allow structurally rigid and reliable assembly while other portions of the guitar body are substituted to incorporate balsa wood, and the entire guitar body is skinned with rigidifying veneer having selected qualities of appearance and finish acceptance. It should be understood too that while one form of double cutaway solid body is illustrated in the drawings, any of various guitar body shapes may be adapted to utilize the lightweight, skinned balsa body structure.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A stringed instrument having a solid body, comprising:

a neck member including a peghead;

a body member having a selected shape and being rigidly affixed to said neck member, said body member being formed from approximately equal parts by volume of balsa wood and a hard wood, with a longitudinally central, generally rectangular segment of said hard wood affixed to said neck member and providing a base for connection of strings, and first and second portions of said balsa wood secured on opposite sides of said segment of hard wood and formed to a selected instrument body shape;

an additional portion of hard wood bonded to said segment of hard wood and defining a cavity for mounting of accessory components; and a removable panel adapted for covering of said cavity.

2. An instrument as set forth in claim 1 which further includes:

a hard wood veneer of selected wood bonded over all external surfaces of said body member.

3. An instrument as set forth in claim 1 which further includes:

at least one cut-out formed in said hard wood segment for receiving at least one pick-up device.

4. An instrument as set forth in claim 3 which is further characterized to include:

longitudinal routing means formed within said hard wood segment and said additional portion of hard wood to receive wire interconnections between said at least one cut-out and said accessory component cavity.

5. A stringed instrument having a solid body, comprising:

a neck member including a peghead; and a body member having a selected body shape and being rigidly affixed to said neck member, said body member being formed from approximately equal portions by volume of balsa wood and a hard wood, said hard wood portion forming the body member and having a generally central part removed to define a central cavity, and said balsa wood portion being bonded within said central cavity of the hard wood portion.

6. An instrument as set forth in claim 5 which further includes:

a hard wood veneer of selected wood bonded over all external surfaces of said body member.

7. An instrument as set forth in claim 5 wherein:

said hard wood is mahogany.

8. An instrument as set forth in claim 5 wherein:

said balsa wood portion is coextensive with and affixed within said central cavity.

9. An instrument as set forth in claim 5 wherein:

said body member has flat top and bottom surfaces formed in generally parallel relationship with a continuous curved side wall defining said body shape.

10. An instrument as set forth in claim 5, wherein:

said body member has a top surface overlayed with a selected veneer.

11. An instrument as set forth in claim 5 wherein said selected veneer comprises:

a two-ply veneer wherein the individual wood grains are arrayed in right angular relationship.

12. An instrument as set forth in claim 5 which further includes:

at least one lesser area of said hard wood portion defining a second cavity to a selected depth for acoustic enhancement, said lesser area being located generally equi-spaced from both the central cavity and the neck member.

13. An instrument as set forth in claim 5 which further includes:

a sound hole of round pattern formed in said hard wood portion, said sound hole being disposed in non-interfering alignment between said central cavity and said neck member.

14. An instrument as set forth in claim 13 which further includes:

at least one lesser area of said hard wood portion defining a second cavity to a selected depth for acoustic enhancement, said lesser area being located generally equi-spaced from both the central cavity and the neck member.

15. An instrument as set forth in claim 5 wherein:

said central cavity is circular and covers a predominant portion of the body member.

16. An instrument as set forth in claim 15 wherein:

said central cavity has a radius of approximately five inches.

17. A stringed instrument having a solid body, comprising:

a neck member including a peghead formed of selected wood;

a body member having a selected shape and being rigidly affixed to said neck member, said body member being formed from approximately equal parts by volume of balsa wood and a hard wood, with a longitudinally central, generally rectangular segment of said hard wood affixed to said neck member and providing a base for connection of strings, and first and second portions of said balsa wood secured on opposite sides of said segment of hard wood and formed to a selected instrument body shape, said body member having flat top and bottom surfaces formed in generally parallel relationship with a continuous curved side wall defining said body shape;

a selected veneer bonded to the top and bottom surfaces;

a second selected veneer bonded to the continuous curved side wall;

an additional portion of hard wood bonded to said segment of hard wood having a cavity defined in the bottom surface for mounting of accessory components; and a removable panel adapted for covering of said cavity.

* * * * *

UNITED STATES PATENT AND TRADEMARK OFFICE

CERTIFICATE OF CORRECTION

PATENT NO. : 5,235,891

DATED : August 17, 1993

INVENTOR(S) : Matthew L. Klein

It is certified that error appears in the above-identified patent and that said Letters Patent is hereby corrected as shown below:

Column 5, line 58, "888" should be --188--.

Claim 11 should be dependent from claim 10.

Signed and Sealed this

Fifteenth Day of March, 1994

Bruce Lehman

*Attest:*

BRUCE LEHMAN

*Attesting Officer*

*Commissioner of Patents and Trademarks*